United States Patent [19]

Lee et al.

[11] 4,227,759

[45] Oct. 14, 1980

[54] CONTAINER HAVING THREADABLE CLIP MEMBERS AND METHOD OF ASSEMBLING SAME

[75] Inventors: Walter Lee, Springfield, Va.; Kenneth C. Litt, Silver Spring, Md.

[73] Assignee: Pace Incorporated, Silver Spring, Md.

[21] Appl. No.: 888,768

[22] Filed: Mar. 21, 1978

Related U.S. Application Data

[63] Continuation-in-part of Ser. No. 773,290, Mar. 10, 1977.

[51] Int. Cl.[2] ..... B65D 7/00; A47B 43/00

[52] U.S. Cl. ..... 312/257 R; 312/257 A; 220/4 E; 220/DIG. 25; 24/73 PF

[58] Field of Search ..... 312/257 R, 257 SK, 257 SM, 312/257 A, 258, 263, 264, 140, 140.1, 140.2, 140.3, 140.4; 220/4 E, 75, DIG. 25; 24/73 P, 73 PF; 403/405, 243, 371, 372; 85/32 V

[56] References Cited

U.S. PATENT DOCUMENTS

| | | | |
|---|---|---|---|
| 1,481,415 | 1/1924 | Casper | 312/257 R |
| 1,828,088 | 10/1931 | Robinson | 220/75 |
| 1,909,136 | 5/1933 | Thomas, Jr. | 312/257 R |
| 2,130,825 | 9/1938 | Bergan | 403/405 |
| 2,421,225 | 5/1947 | Stensgaard | 220/4 E |
| 2,741,390 | 4/1956 | Moore | 220/DIG. 25 |
| 2,788,047 | 4/1957 | Rapata | 24/73 P |
| 3,628,816 | 12/1971 | Ross, Jr. | 403/405 |
| 4,002,287 | 1/1977 | Saveth | 220/DIG. 25 |

FOREIGN PATENT DOCUMENTS

| | | | |
|---|---|---|---|
| 821902 | 10/1959 | United Kingdom | 24/73 PF |
| 1437648 | 6/1976 | United Kingdom | 85/32 V |

*Primary Examiner*—Victor N. Sakran
*Attorney, Agent, or Firm*—Gerald J. Ferguson, Jr.; Joseph J. Baker

[57] ABSTRACT

A container having two channel-like members which mate with one another to form an enclosure and a plurality of threadable clip members attached to the channel-like members, each threadable clip member having a threadable slot where (a) the slots of certain ones of the clip members respectively receive predetermined edges of the channel-like members and (b) screws or the like may be threaded in the slots of the remaining ones of the threadable clip members, the screws extending through holes provided in the channel-like members to thereby secure the latter members together.

5 Claims, 12 Drawing Figures

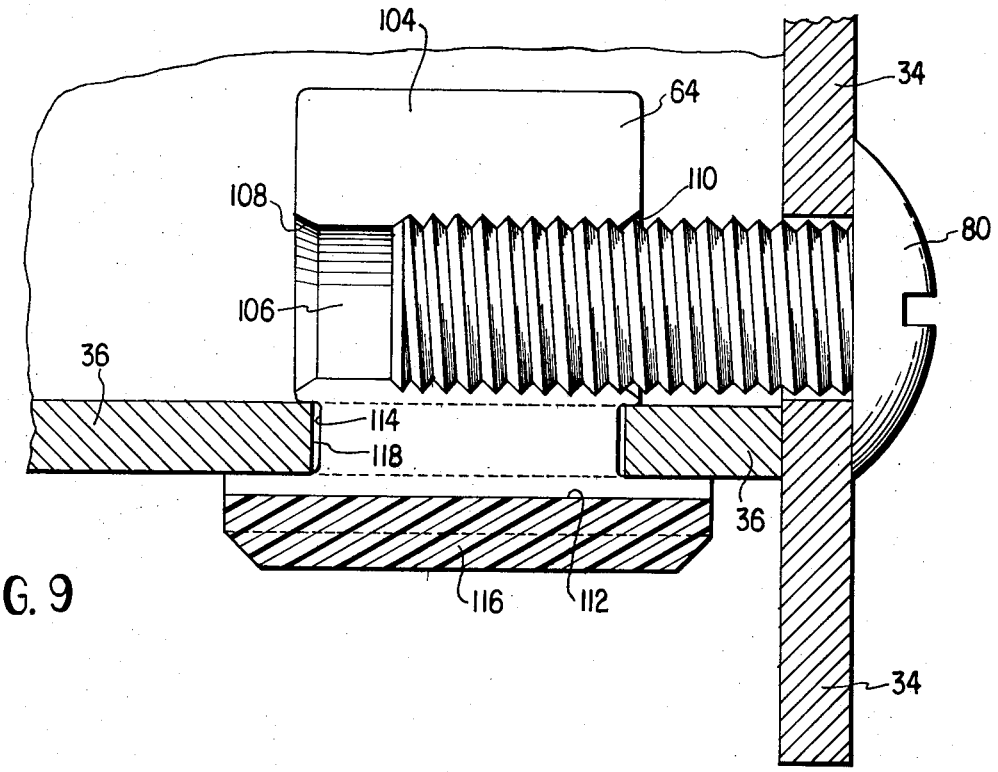
FIG. 9
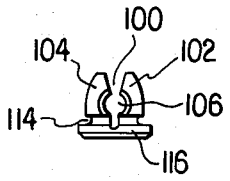
FIG. 10
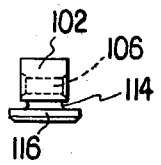
FIG. 11
FIG. 12
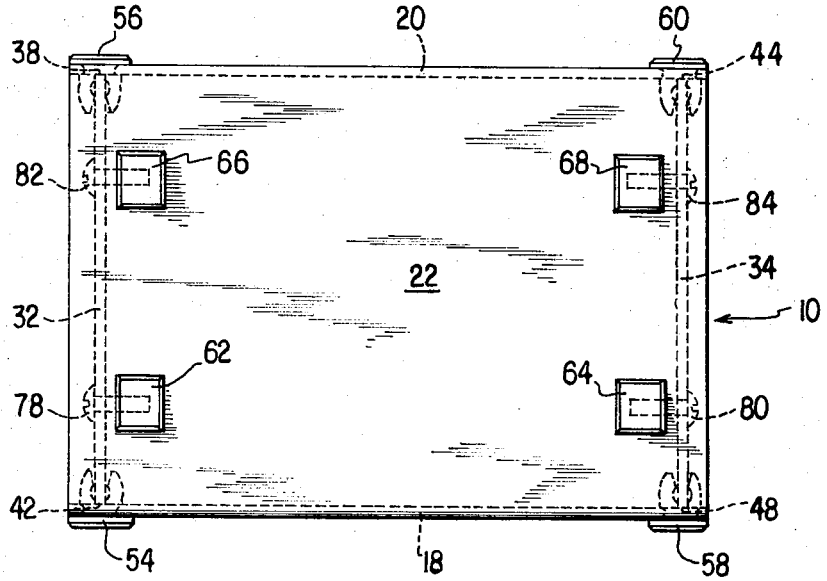

CONTAINER HAVING THREADABLE CLIP MEMBERS AND METHOD OF ASSEMBLING SAME

RELATED APPLICATION

This application is a continuation-in-part of allowed U.S. Application Ser. No. 773,290, filed by Walter Lee and Kenneth C. Litt on Mar. 10, 1977 and entitled "Collapsible Container and Method of Making Same", the foregoing application being incorporated herein by reference.

BACKGROUND OF THE INVENTION

1. Field of the Invention

This invention relates to containers and in particular, to an improved container and method of assembling same.

2. Discussion of the Prior Art

Collapsible containers are known and have been disclosed in such patents as U.S. Pat. Nos. 1,828,088 and 2,421,225. As disclosed in U.S. Pat. No. 1,828,088, it is advantageous to ship a container in a disassembled condition, the container being assembled after it reaches its point of destination. Other patents disclosing containers are U.S. Pat. Nos. 2,456,929, 2,472,015, 3,316,460 and 3,966,285.

Various shortcomings are associated with the prior art containers. For example, the container disclosed in U.S. Pat. No. 1,828,088 is complicated and difficult to construct while that disclosed in U.S. Pat. No. 2,421,225 is not only difficult to construct but is not sufficiently rigid for many purposes.

SUMMARY OF THE INVENTION

It is thus a primary object of this invention to provide an improved container which may be shipped in disassembled form, which is easily assembled and which is sturdy after it is assembled.

It is a further object of this invention to provide an improved method for assembling such a container.

It is a further object of this invention to provide an improved threaded or threadable clip for assembling containers of the above type.

Other objects and advantages of this invention will be apparent from a reading of the following specification and claims taken together with the drawing.

BRIEF DESCRIPTION OF THE DRAWING

FIGS. 8 and 9 are cross-section views taken respectively along the lines 8—8 and 9—9 of FIG. 3.

FIGS. 10 and 11 are respective end and side views of an illustrative clip member.

FIG. 12 is a top plan view of an illustrative assembled container in accordance with a further embodiment of the invention.

DETAILED DESCRIPTION OF THE PREFERRED EMBODIMENTS OF THE INVENTION

Figure 1:
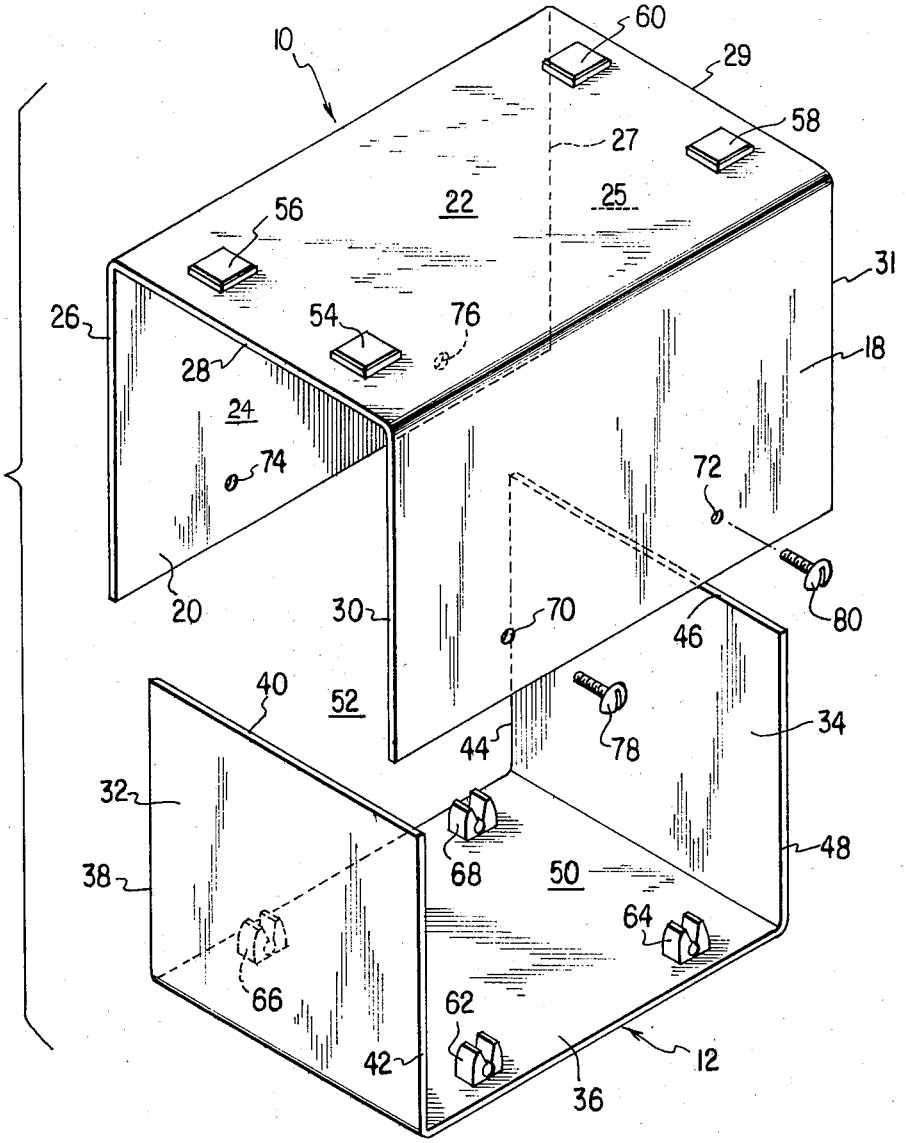
FIG. 1 is an exploded perspective view of an illustrative collapsible container in accordance with this invention.
Figure 2:
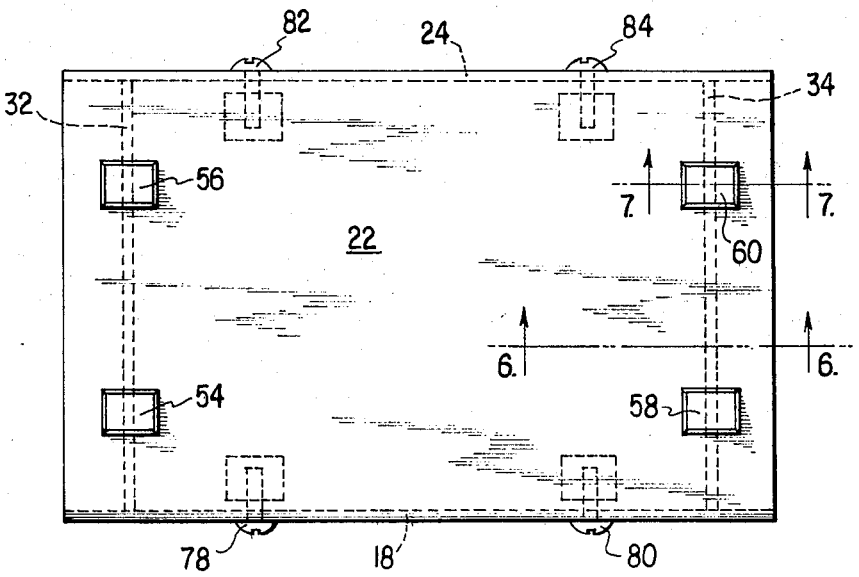
FIG. 2 is a top plan view of an illustrative assembled container in accordance with this invention.
Figure 3:
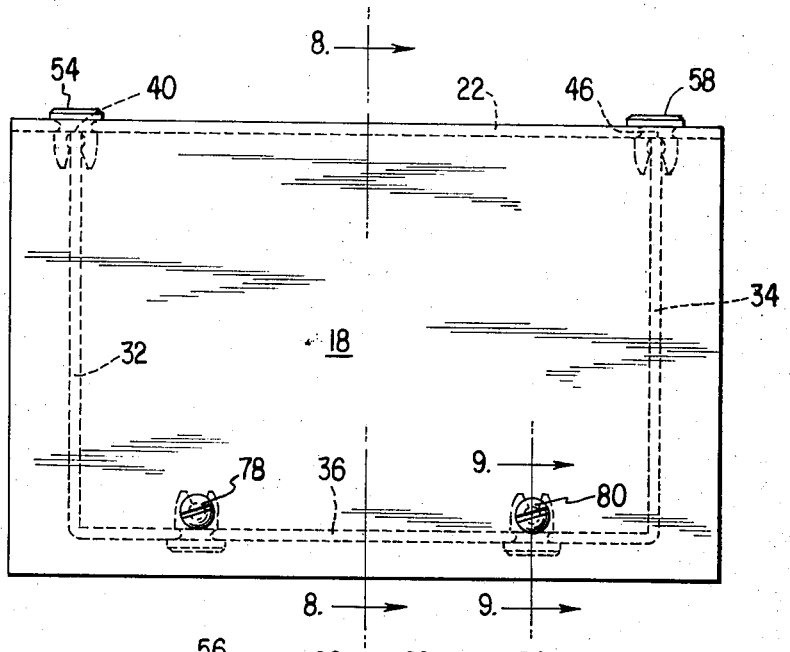
FIG. 3 is a side elevation view of the container of FIG. 2.
Figure 4:
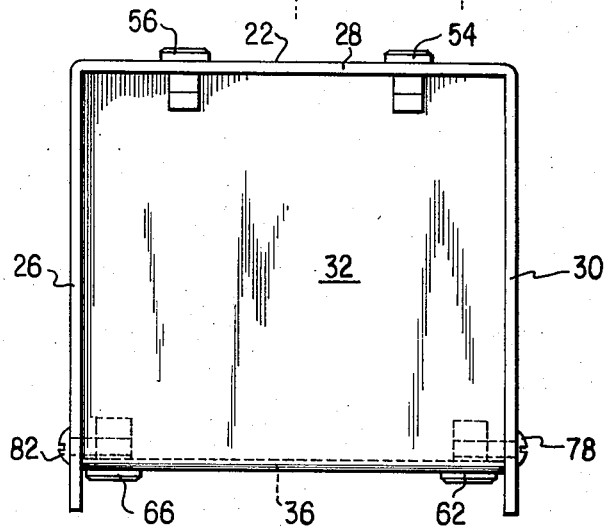
FIG. 4 is an end elevation view of the container of FIG. 2.
Figure 5:
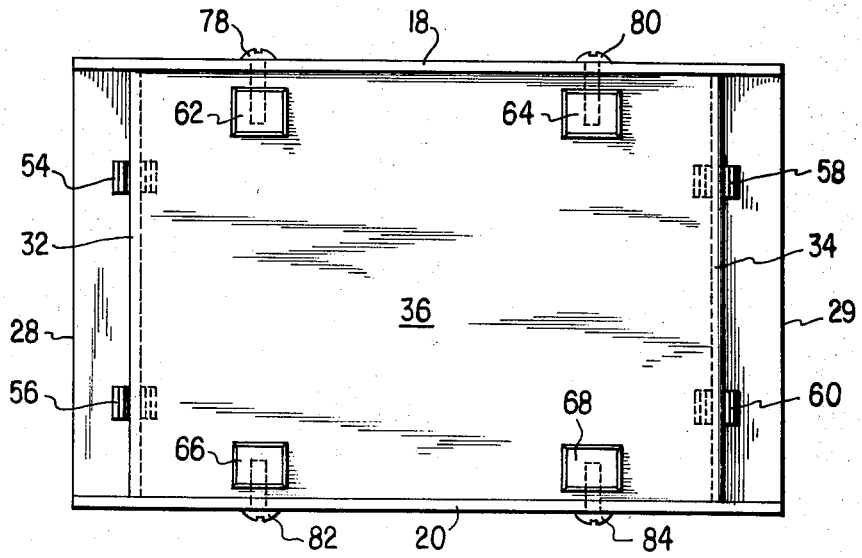
FIG. 5 is a bottom view of the container of FIG. 2.
Figure 6:
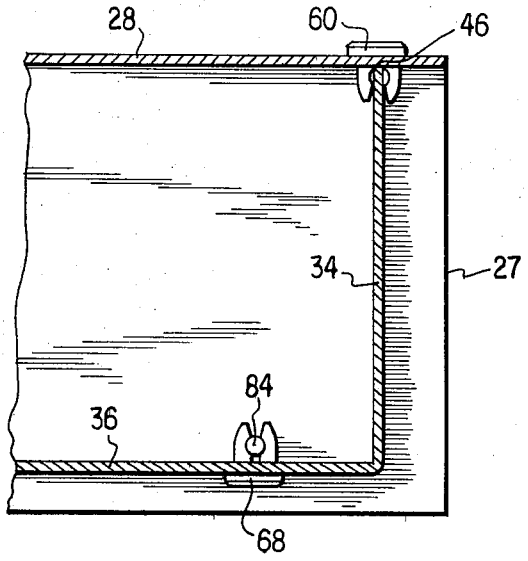
FIGS. 6 and 7 are cross-section views taken respectively along the lines 6—6 and 7—7 of FIG. 2.

Referring to the Figures of the drawing where like reference numerals refer to like parts, there is illustrated in FIG. 1 an exploded perspective view of a collapsible container in accordance with this invention. The collapsible container basically comprises two parts—that is, cover panel or first channel-like member 10 and chassis or second channel-like member 12. The cover 10 has two side members or plates 18 and 20 preferably integrally connected to an intermediate plate or member 22. Further, cover 10 has two open ends one of which is generally indicated at 24 and the other at 25. The open ends each define U-shaped edges where the U-shaped edge defined by open end 24 corresponds to edge 26 of plate 20, edge 28 of plate 22 and edge 30 of plate 18 and the U-shaped edge defined by open end 25 corresponds to edge 27 of plate 20, edge 29 of plate 22 and edge 31 of plate 18.

Chassis 12 comprises two side plates or members 32 and 34 preferably integrally connected to an intermediate plate or member 36. Each of the side plates 32 and 34 define U-shaped edges where the U-shaped edge defined by plate 32 corresponds to edges 38, 40 and 42 thereof while the U-shaped edge defined by plate 34 corresponds to edges 44, 46 and 48 thereof.

Chassis 12 has open ends generally indicated at 50 and 52. Further, the length of chassis 12 extending from open end 50 to end 52 is preferably slightly less than the width of intermediate plate 22 of cover 10 extending from side plate 18 to plate 20. Also the width of intermediate plate 36 of chassis 12 extending from side plate 32 to plate 34 is preferably less than the length of cover 10 extending from open end 24 to end 25 thereof. Hence, cover 10 and chassis 12 tend to mate with one another to form an enclosed container.

In order to simply and securely mate cover 10 and chassis 12 together as a collapsible container, clip members 54–68 are provided and may be employed in various arrangements to effect the mating of cover 10 and chassis 12. One such arrangement is shown in FIGS. 1–5 where four of the clip members 54–60 may be secured through rectilinear holes in the plate 22 of panel cover 10 to hold the upper edges 40 and 46 of plates 32 and 34 in place as shown in FIGS. 2, 3, 5, 6 and 7 and where another four of the clip members 62–68 are secured through holes in plate 36 of chassis 12 and have respectively threaded therein screws 78–84 to hold the lower edges of plates 18 and 20 in place as shown in FIGS. 3, 5, 6, 8 and 9. Thus, as will be described in more detail below, clip members 54–68, all of which are structurally the same, serve one or the other of two basically different functions.

Figure 7:
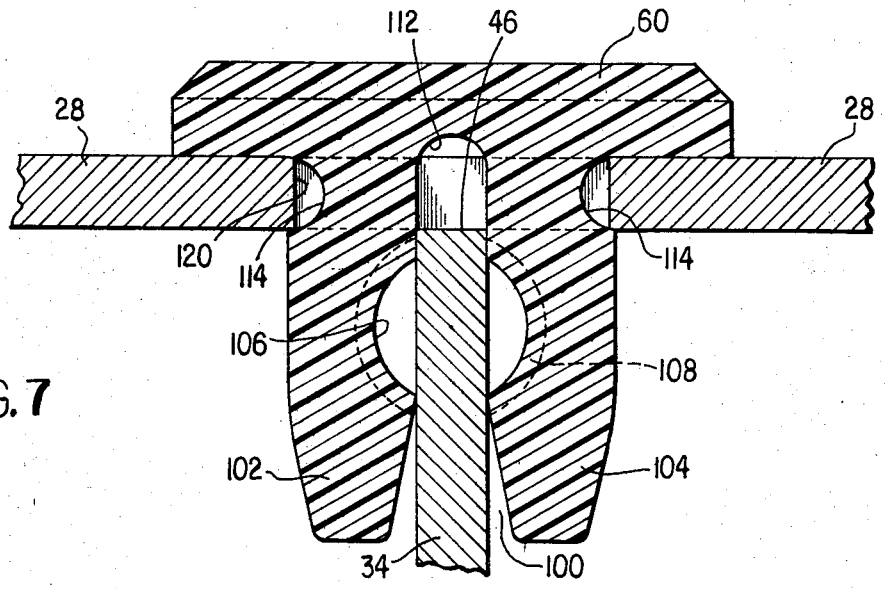
Figure 8:
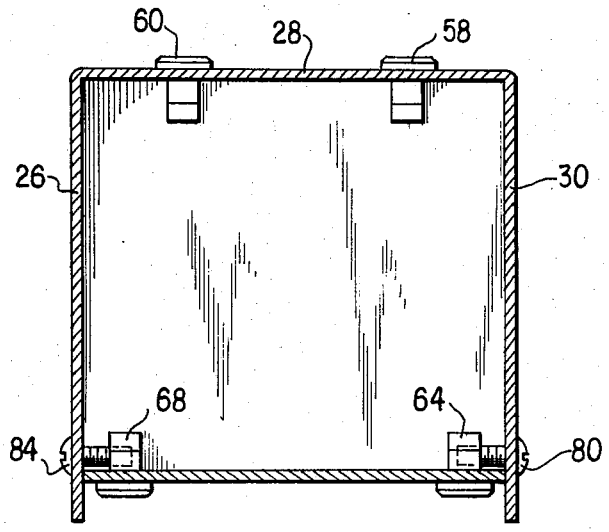

Illustrative structural details of clip members 54–68 may be understood in relation to FIGS. 7, 9, 10 and 11 where FIGS. 7 and 9 respectively show in cross-section clip members 60 and 64 and FIGS. 10 and 11 are respective end and side views of any one of the clip members 54–68, the latter views being representative actual size views of typical clip members. Each clip member has a longitudinal slot 100 into which may be inserted a plate such as end plates 32 and 34 of chassis 12 where plate 34 is shown inserted into slot 100 of clip member 60 in FIG. 7. The slot 100 is defined by legs 102 and 104 and a hole 106 extends along the length thereof where the hole may be beveled at the ends thereof as indicated at 108 and 110 in FIG. 9. Further, the material from which the clip members 54–68 are made is such that the hole 106 may be threaded upon rotation therein of a self-tapping screw such as screw 80 of FIG. 9 where the material may typically be moldable nylon. Further, the hole may be internally threaded beforehand if so desired. The slot 100 bottoms at 112 to thereby permit reception of a portion of the upper edge of plate 34.

At the bottom of legs 102 and 104 is disposed a groove 114 and a base 116 so that the clip members may be inserted through preferably rectangular holes in cover 10 and chassis 12. Two of these holes are shown at 118 and 120 in FIGS. 9 and 7 respectively. The material from which the clip members are made is sufficiently resilient so that the legs 102 and 104 of clip member 60, for example, flex towards one another as they are pressed through hole 120. At this time the base 116 also flexes to facilitate compression of slot 100 until the plate 28 fits into groove 114, at which time legs 102 and 104 snap open. Insertion of plate 34 into slot 100 pushes the legs 102 and 104 further apart to lock clip member 60 in plate 28 and hold plate 34 in place.

In the FIG. 9 embodiment, plate 34 is retained in place by screw 80 which may, for example, be a #8 self-tapping sheet metal screw. When the screw is tightened, the edge of hole 118 is drawn into groove 114 locking clip member 64 in place.

As stated hereinbefore, the container of the present invention is particularly suitable for those applications where it is convenient to ship the container to a remote destination at which place the container is put together. In particular, the container may be shipped in essentially two-dimensional form to thereby effect appropriate economies. Thus, cover 10 and chassis 12 can be shipped as flat pieces of sheet metal or the like and formed as illustrated in FIG. 1 after reaching the point of destination where the clip members would be inserted as shown. The cover 10 and chassis 12 would then be mated by inserting the edges of edge 40 into the slots 100 of clip members 54 and 56 and the edge 46 into the slots 100 of clip members 58 and 60 where the insertion of edge 46 in clip member 60 is shown in FIG. 7. The mated cover 10 and chassis 12 would then be secured together by screwing screws 78–84 through holes 70–76 into holes 106 of clip members 62–68 where in FIG. 9, there is shown screw 80 threaded into hole 106 of clip member 64.

It should be noted that the number of the clip members 54–68 shown in FIG. 1 may be varied and still effect the mating and securing of cover 10 and chassis 12. Thus, for example, clip members 62 and 66 may be eliminated whereby clip members 64 and 68 would be centrally disposed between plates 32 and 34 to secure cover 10 and chassis 12 together. In a similar manner clip members 54 and 58 could be eliminated.

Also the arrangement of the clip members can be varied in a number of different ways to effect the mating and securing of cover 10 and chassis 12. Thus, for example, as shown in FIG. 12, the clip members 54 and 58 could be mounted in plate 18 to receive the edges 42 and 48 while the clip members 56 and 60 could be mounted in plate 20 to receive the edges 38 and 44 to thereby effect the mating of cover 10 and chassis 12. The mated cover and chassis could then be secured to one another by mounting clip members 62–68 in plate 22 whereby screws 78 and 82 would be inserted through holes in plate 32 and threaded into clip members 62 and 66 while screws 80 and 84 would be inserted through holes in plate 34 and threaded into clip members 64 and 68.

What is claimed is:

1. A container comprising two channel-like members which mate with one another to form an enclosure and a plurality of threadable clip members attached to the channel-like members, each threadable clip members having a threadable slot where (a) the slots of certain ones of the clip members respectively receive predetermined edges of the channel-like members and (b) screws or the like may be threaded in the slots of the remaining ones of the threadable clip members, the screws extending through holes provided in the channel-like members to thereby secure the latter members together.

2. A container as in claim 1 where each said clip member includes a base and a pair of legs extending from said base to define a slot between the legs, the legs each have an interior semicircular channel disposed therein, said channels being in facing relation to form a longitudinally extending hole in the direction of said slot, said hole being adapted for receiving one of said screws.

3. A container as in claim 2 where a plurality of further holes are disposed in at least one of said channel-like members for receiving said clip members and where each said clip member includes an exterior groove disposed about the lower portion of said legs adjacent said base to receive the edges of one of said plurality of further holes.

4. A container as in claim 3 where said slot of each clip member extends into said base.

5. A method of assembling a container having two channel-like members which mate with one another to form an enclosure and a plurality of threadable clip members attached to the channel-like members, each threadable clip member having a threadable slot where (a) the slots of certain ones of the clip members respectively receive predetermined edges of the channel-like members and (b) screws or the like may be threaded in the slots of the remaining ones of the clip members, the screws extending through holes provided in the channel-like members to thereby secure the latter members together, said method comprising the steps of bending two flat members to respectively form said two channel-like members, attaching said clip members to at least one of said channel-like members, inserting said predetermined edges of one of said channel-like members into the slots of said certain ones of said clip members to thereby mate the channel-like members together to form said enclosure, and threading said screws through said holes into the slots of said remaining ones of the clip members to thereby secure the latter members together.

* * * * *